United States Patent [19]

Cosmos et al.

[11] Patent Number: 4,506,937

[45] Date of Patent: Mar. 26, 1985

[54] LATCHING-GROUNDING BLOCKS

[75] Inventors: Pete Cosmos, Mechanicsburg; Earl C. Myers, Jr., Harrisburg, both of Pa.

[73] Assignee: AMP Incorporated, Harrisburg, Pa.

[21] Appl. No.: 490,702

[22] Filed: May 2, 1983

[51] Int. Cl.[3] ..... H01R 4/66

[52] U.S. Cl. ..... 339/14 R

[58] Field of Search ..... 339/14 R, 143 R, 136 R

[56] References Cited

U.S. PATENT DOCUMENTS

| | | | |
|---|---|---|---|
| 3,566,336 | 2/1971 | Johnson et al. . | |
| 3,569,915 | 3/1971 | Sorensen et al. . | |
| 3,670,292 | 6/1972 | Tracy . | |
| 3,670,409 | 6/1972 | Reimer . | |
| 3,703,701 | 11/1972 | Zimmerman . | |
| 3,825,874 | 7/1974 | Peverill . | |
| 3,854,107 | 12/1974 | Tuchto et al. . | |
| 4,020,430 | 4/1977 | Vander Heyden . | |
| 4,215,326 | 7/1980 | Hollyday | 339/143 R X |
| 4,381,129 | 4/1983 | Krenz | 339/14 R |
| 4,398,780 | 8/1983 | Novotny et al. | 339/143 R X |
| 4,420,201 | 12/1983 | Stephenson | 339/143 R X |

*Primary Examiner*—Eugene F. Desmond

*Attorney, Agent, or Firm*—Russell J. Egan

[57] ABSTRACT

A metal latching-ground block is used in conjunction with mating electrical connectors to form both a locking means and a ground path. One embodiment is a unitary block member which has mounting portions at both ends of the connector, each portion including a surface having a formed or captivated nut opening to receive fastening means from the mating member and a grounding tab acting in conjunction with the mounting means for the connector member. The other embodiment is individual latching-ground blocks received on each end of a connector member each block defining a pair of spaced surfaces having formed or captivated nut openings, each of which receives a respective fastener from each of the connector members to secure them together.

7 Claims, 6 Drawing Figures

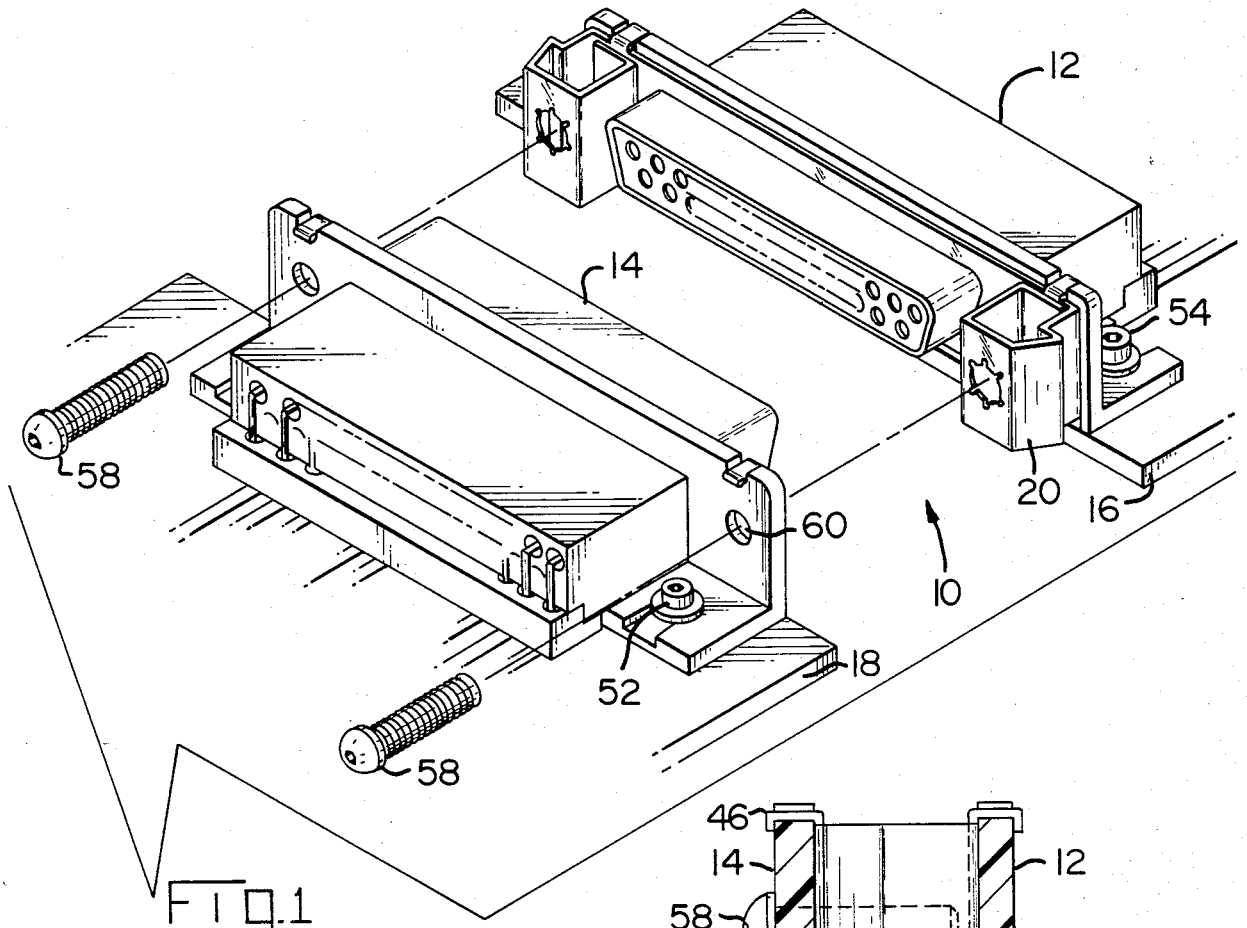
FIG. 1
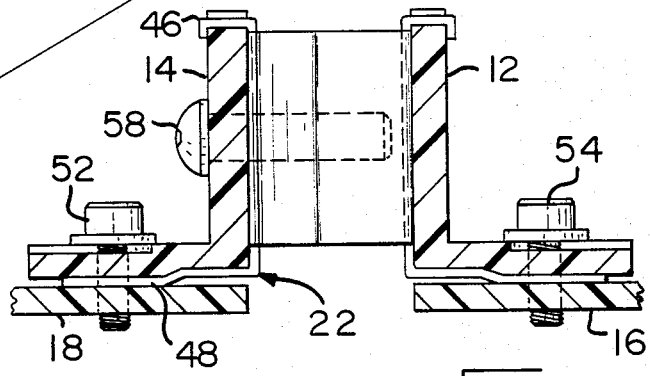
FIG. 2
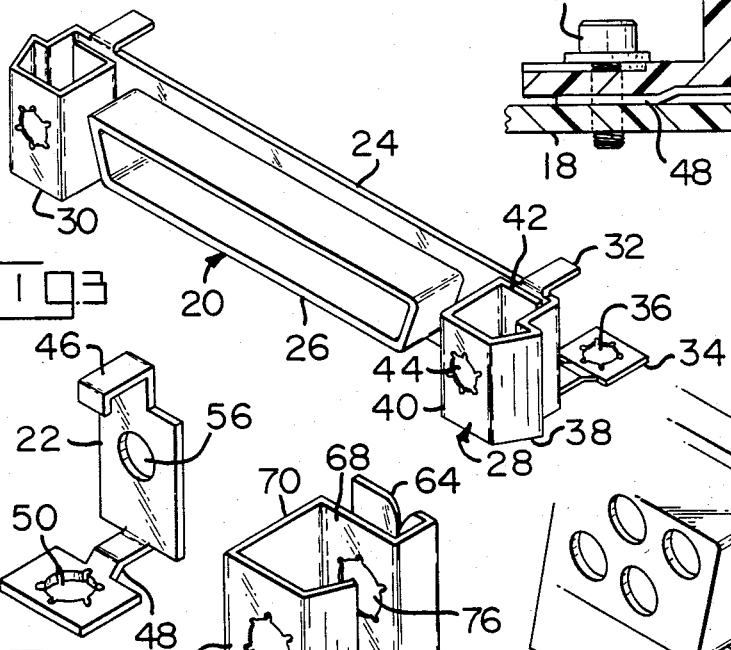
FIG. 3
FIG. 4
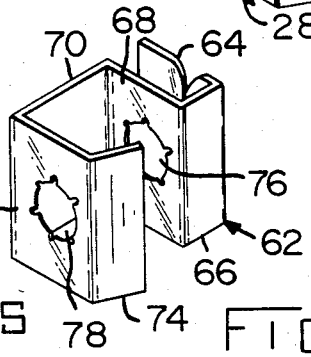
FIG. 5
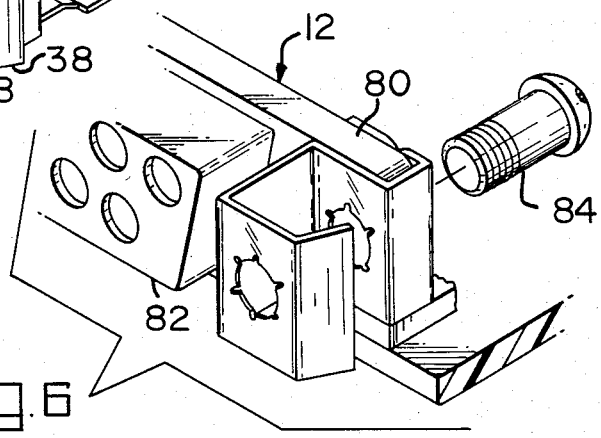
FIG. 6

LATCHING-GROUNDING BLOCKS

The present invention relates to a latching block providing an improved inexpensive means for latching connectors together and in particular to a block providing an improved ground path.

There is often the need to secure electrical connectors together to ensure that they will not become unmated unintentionally. Frequently, means in addition to the frictional contact engagement of the terminals and connectors is necessary, especially when high vibration conditions may be expected. Also, in view of the current concern about radio frequency and electro-magnetic interference, it is highly desirable that any electrical connector system have the capability of being shielded and/or grounded.

The present invention overcomes this need of the prior art by providing an inexpensive latching block which can be applied to a connector to provide both latching and grounding functions. The present invention is a metallic member mounted on each of an elongated insulative housing of an electrical connector with the member defining a pair of parallel spaced surfaces each formed with a central aperture defining a formed or captivated type nut. Each member further includes means to latchingly engage the housing and a grounding tab. The members can be formed in an integral unit at opposite ends of an apertured plate, the aperture allowing passage of the mating face of the connector.

Two embodiments of the present invention will now be described by way of example with reference to the accompanying drawings in which:

FIG. 1 is a perspective view of an unmated pair of connector members provided with the latching-grounding block of the present invention;

FIG. 2 is a side elevation of the connector members of FIG. 1 in a mated condition;

FIG. 3 is a perspective view of the latching-grounding block of FIGS. 1 and 2;

FIG. 4 is a perspective view of the grounding bar of FIGS. 1 and 2;

FIG. 5 is a perspective view of an alternate block according to the present invention; and FIG. 6 is a perspective view of the alternate block of FIG. 5 mounted on an electrical connector.

The present invention is shown in cooperation with an electrical connector 10 which includes a first mating member 12 and a second mating member 14 each mounted on an edge portion on a respective circuit board 16, 18. The subject latching-ground block 20 is shown mounted on the first mating member 12 while a grounding bar 22 is mounted on the second mating member 14.

The subject block is best shown separately in FIG. 3 and includes a planar central web 24 having an aperture therein surrounded by a shroud 26. The latching grounding block portions 28, 30 are integral with each respective end of the planar portion 24. Each block includes a mounting tab 32 extending from one marginal edge of the planar portion 24 and a grounding tab 34 extending from the opposite marginal edge. Both tabs 32, 34 extend from the planar portion 24 in the opposite direction from the shroud 26. The grounding tab 34 is also provided with a profiled aperture 36 which makes contact with a mounting member to be described later. Each block also includes a profiled flange 38 which defines a pair of surfaces 40, 42 which are parallel and spaced apart. At least the surface 40 is provided with a profiled aperture 44 having a formed or captivated nut configuration.

Each grounding bar 22 has a latching tab 46 at one end thereof and a grounding tab 48 at the other thereof with an aperture 50 therein to receive mounting means 52 to secure the member 14 to the circuit board 18 while grounding the ground bar 22 against a ground on the circuit board 18. In like manner the mounting means 54 grounds the latching-ground block 20 to the circuit board 16 as it mounts the member 12 on the circuit board 16. Each grounding bar further has an aperture 56 through which securing means 58 passes.

It will be best appreciated from FIG. 2 how the present invention operates to latch the connector members 12, 14 together. When the connector members 12, 14 are properly mated, a further fastening means 58 is applied through the aperture 60 of the member 14 and aperture 56 of the grounding bar 22 to engage in the nut 44 and hold the connector members 12, 14 together. It is also readily apparent that the latching-ground block 20 will engage the grounding bar 22 in this condition thereby providing a complete ground path for the associated circuitry.

A single latching block embodiment is shown in FIGS. 5 and 6. In this embodiment the block 62 is a single member of conductive material having an overall S-shape profile formed by first a series of integral planar portions 64, 66, 68, 70, 72, 74. It is readily apparent that portions 64, 68 are parallel and closely spaced so as to engage opposite sides of a mounting flange 80 of the associate connector member 12. The portions 68 are parallel to and spaced from the portion 72 and both portions 68, 72 are provided with profiled apertures 76, 78, respectively, the apertures having a profile of a formed or captivated nut. The portion 70 is also of sufficient length that the portion 72 lies approximately coplanar with the mating face 82 of the connector member. This embodiment is used by slipping it over the end of the mounting flange 80 of the member 12, as shown in FIG. 6, with a fastening means 84 being applied through the flange 80 to secure the block thereto. The means 84 will engage in the nut 76. In order to secure a mating connector member 14 of FIG. 1 to this embodiment, the fastening means 58 would be applied through the aperture 60 to engage in the nut 78 securing the connector members 12, 14 together.

It should be noted that any suitable fastening or mounting means may be used with the present invention. The means shown are for illustrative purposes only. Also the formed or captivated nuts can be of the style known as Tinnerman nuts. Further, while the present invention has been shown with circuit board mounted connectors, it is within the perview of the invention to use it in other applications, such as cable-to-cable assemblies as well as cable-to-board assemblies. Only minor changes in securing the block to cable ground or shielding would be necessary for these other applications.

We claim:

1. In combination with an electrical connector having an insulative housing with a peripheral flange, a latching-grounding block comprising:

a conductive block having a substantially S-shaped profile with three parallel planar portions the first and second of which are closely spaced to form a first connector gripping portion to grip the peripheral flange of the connector there between and the third planar portion being spaced from the other planar portions to be approximately even with a mating face of the connector forming a second fastening member receiving portion, said third planar portion and at least one of said first and second planar portions having a formed or captivated nut configuration.

2. A latching-grounding block according to claim 1 further comprising a grounding tab integral with said conductive block and adapted to mate with ground through connector mounting means.

3. The latching-grounding block according to claim 1 further comprising:

an elongated planar conductive member having a conductive block integral with each end thereof, said elongated planar conductive member having a central elongated aperture exposing the mating face of said connector.

4. The latching-grounding block according to claim 3 further comprising:

a shround integral with said planar conductive member and enclosing the periphery of said elongated aperture.

5. In combination with a pair of mating electrical connector members, each member having at least one mateable terminal enclosed within a housing of insulative material with at least one integral mounting flange, a latching-grounding block assembly comprising:

a conductive latching-ground member mounted on one of said connector members, said conductive latching-ground member being an elongated planar metal member with an elongated aperture therein exposing a mating face of said one connector member and a block profile at each end of said elongated member, each said block profile having at least one tab extending normal to a marginal portion thereof forming a connector member gripping portion, a captivated or formed nut configuration defining a fastening member receiving portion, and an apertured tab forming a ground connection portion extending from another marginal portion to receive connector mounting means there through and contact system ground, and a grounding bar mounted on the other of said connector members and having a connector member gripping portion, a fastening member aperture, and a ground connection portion, whereby fastening means passing through said grounding bar engages said fastening member receiving portion to secure said connector members together.

6. The assembly according to claim 5 further comprising an integral shroud about the periphery of said elongated aperture.

7. The assembly according to claim 5 wherein said fastening member receiving portion is substantially coplanar with the mating face of said connector member.

* * * * *